US010385434B2

(12) United States Patent
Schloffer et al.

(10) Patent No.: US 10,385,434 B2
(45) Date of Patent: Aug. 20, 2019

(54) PROCESS AND APPARATUS FOR PRODUCING FORGED TIAL COMPONENTS

(71) Applicant: MTU Aero Engines AG, Munich (DE)

(72) Inventors: Martin Schloffer, Munich (DE); Wilfried Smarsly, Munich (DE); Marc Haltrich, Kolbermoor (DE)

(73) Assignee: MTU AERO ENGINES AG, Munich (DE)

( * ) Notice: Subject to any disclaimer, the term of this patent is extended or adjusted under 35 U.S.C. 154(b) by 585 days.

(21) Appl. No.: 15/191,038

(22) Filed: Jun. 23, 2016

(65) Prior Publication Data

US 2016/0376689 A1 Dec. 29, 2016

(30) Foreign Application Priority Data

Jun. 24, 2015 (DE) ..... 10 2015 211 718

(51) Int. Cl.

| | |
|---|---|
| ***C22F 1/18*** | (2006.01) |
| ***B22D 13/02*** | (2006.01) |
| ***B22D 13/06*** | (2006.01) |
| ***C22C 14/00*** | (2006.01) |
| ***B21J 5/00*** | (2006.01) |
| ***B21K 3/04*** | (2006.01) |
| ***B22D 13/04*** | (2006.01) |
| ***B22D 21/00*** | (2006.01) |
| ***B22D 13/10*** | (2006.01) |

(52) U.S. Cl.

CPC ..... *C22F 1/183* (2013.01); *B21J 5/002* (2013.01); *B21K 3/04* (2013.01); *B22D 13/023* (2013.01); *B22D 13/04* (2013.01); *B22D 13/066* (2013.01); *B22D 13/101* (2013.01); *B22D 21/005* (2013.01); *C22C 14/00* (2013.01)

(58) Field of Classification Search

CPC ..... C22F 1/183; C22C 14/00; B22D 21/005; B22D 13/04; B21J 5/002; B21K 3/04

See application file for complete search history.

(56) References Cited

U.S. PATENT DOCUMENTS

| | | | |
|---|---|---|---|
| 3,203,794 | A | 8/1965 | Jaffee et al. |
| 5,826,322 | A | 10/1998 | Hugo et al. |
| 6,250,366 | B1 | 6/2001 | Choudhury et al. |
| 6,443,212 | B1 | 9/2002 | Choudhury et al. |
| 6,755,239 | B2 | 6/2004 | Ray et al. |
| 2001/0041149 | A1 | 11/2001 | Mino |
| 2001/0045267 | A1 | 11/2001 | Choudhury et al. |
| 2004/0025982 | A1 | 2/2004 | Mino |
| 2004/0040690 | A1 | 3/2004 | Roy et al. |
| 2004/0045644 | A1 | 3/2004 | Guther et al. |
| 2010/0031914 | A1 | 2/2010 | Fukumoto et al. |

FOREIGN PATENT DOCUMENTS

| | | | |
|---|---|---|---|
| DE | 1301877 | A | 8/1969 |
| DE | 4420138 | C2 | 9/1997 |
| DE | 19639514 | C1 | 12/1997 |
| DE | 19846781 | A1 | 4/2000 |
| DE | 10024343 | A1 | 11/2001 |
| DE | 60114281 | T2 | 7/2006 |
| DE | 102008021906 | A1 | 10/2008 |
| RO | 103095 | B1 | 1/1993 |

*Primary Examiner* — Jessee R Roe

(74) *Attorney, Agent, or Firm* — Abel Schillinger, LLP

(57) ABSTRACT

An apparatus and a process for producing forged components composed of TiAl alloys, wherein a melt of a TiAl alloy is provided and is cast by horizontal centrifugal casting so as to produce at least one semifinished TiAl cast part and the semifinished TiAl cast part is converted by forging into a forged TiAl part.

14 Claims, 4 Drawing Sheets

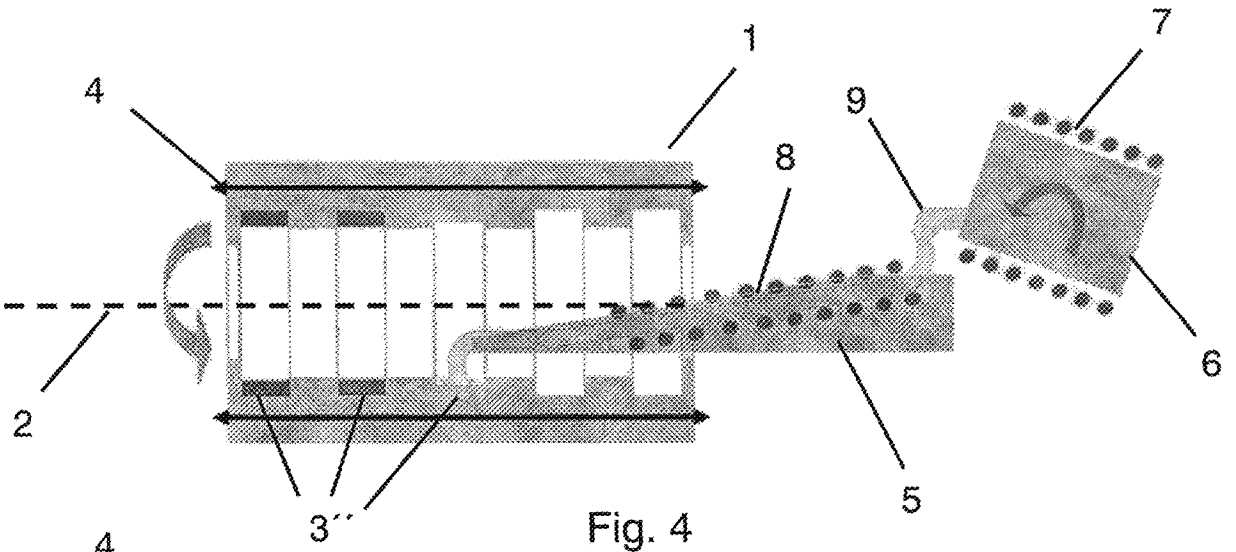
Fig. 4
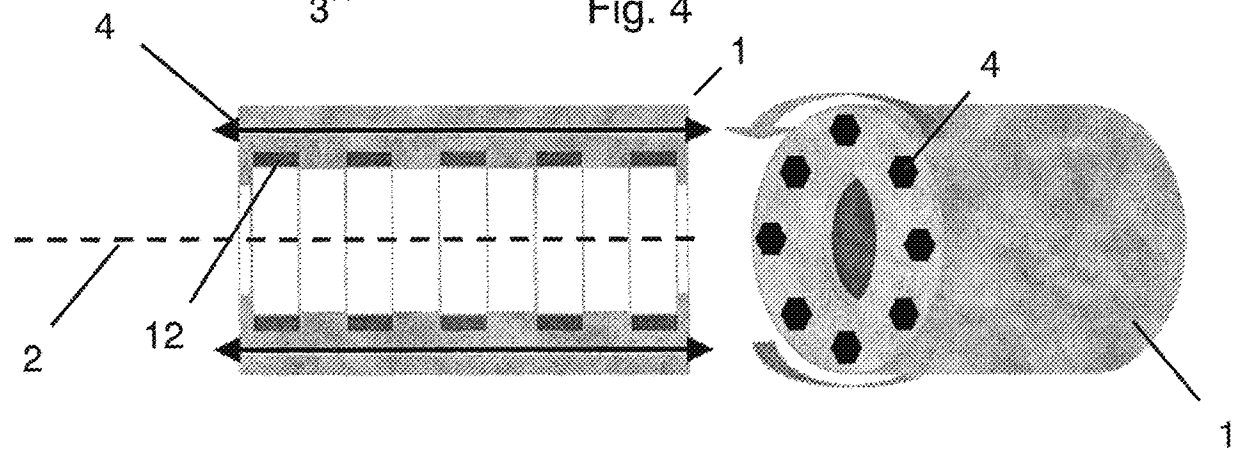
Fig. 5
Fig. 6

PROCESS AND APPARATUS FOR PRODUCING FORGED TIAL COMPONENTS

CROSS-REFERENCE TO RELATED APPLICATIONS

The present application claims priority under 35 U.S.C. § 119 of German Patent Application No. 102015211718, filed Jun. 24, 2015, the entire disclosure of which is expressly incorporated by reference herein.

BACKGROUND OF THE INVENTION

1. Field of the Invention

The present invention relates to a process and an apparatus for producing forged components of TiAl alloys, in particular for turbomachines such as stationary gas turbines or aircraft engines.

2. Discussion of Background Information

Components of TiAl materials, i.e. which comprise titanium and aluminum as main constituents, are of great interest for applications in which components have to be moved at high speed, for example as blades of turbo machines, since they have a high strength combined with a low specific gravity. However, such materials are difficult to process since the materials have to have a defined structure with a specific microstructure in order to achieve the desired property profile of the components.

However, phase separations and aluminum segregations can occur during casting of TiAl materials, so that an inhomogeneous microstructure can be established. In addition, coarse microstructures which have an adverse effect on the mechanical properties can be formed.

In view of the foregoing, it would be advantageous to have available a process for producing TiAl components, which process allows efficient production of components composed of TiAl alloys having a defined property profile and a desired microstructure, and, in particular, forged to TiAl components for use in turbomachines. It also would be advantageous to have available a suitable apparatus for carrying out the process.

SUMMARY OF THE INVENTION

The present invention provides a process for producing a forged component of a TiAl alloy. The process comprises casting a melt of the TiAl alloy by horizontal centrifugal casting to produce at least one semifinished TiAl cast part and forging the semifinished TiAl cast part into a forged TiAl part.

In one aspect of the process, the semifinished TiAl cast part may be in the form of a cylinder, a cone or a ring.

In another aspect, the semifinished TiAl cast part may be produced by parting. For example, the semifinished TiAl cast part may be produced by dividing or machining of a cast piece.

In yet another aspect, the TiAl alloy may be cast in a permanent mold to afford a plurality of separated semifinished TiAl cast parts.

In a still further aspect of the process, the TiAl alloy may be cast to afford a semifinished TiAl cast part in the form of a ring or tube having a length of from 5 to 300 cm and/or a wall thickness of from 4 to 30 cm and/or an internal diameter of from 10 to 100 cm.

In another aspect, the TiAl alloy may be a TNM alloy comprising niobium and molybdenum constituents. For example, the TiAl alloy may comprise, based on the total weight of the alloy, from 40 to 50% by weight aluminum (e.g., from 42 to 45% by weight of aluminum), from 2 to 6% by weight niobium, from 0.5 to 2% by weight molybdenum, from 0.05% by weight to 0.15% by weight boron, balance Ti and unavoidable impurities and/or alloy constituents in proportions of in each case less than 0.5% by weight up to a total proportion of not more than 5% by weight (e.g., not more than 2% by weight).

In another aspect, the semifinished TiAl cast part may have a microstructure formed by (particularly elongated) colonies of α-Ti and γ-TiAl which are embedded in β-Ti. Lens shaped precipitates of γ-TiAl may be formed in the β-Ti.

In another aspect of the process, the phase composition of the semifinished TiAl cast part may deviate from the equilibrium phase composition at room temperature by up to 10% by volume, e.g., by up to 8% by volume.

In another aspect, the semifinished TiAl cast part may be subjected to a plurality of forming steps by forging and/or at least one heat treatment.

In another aspect, the semifinished TiAl cast part in the form of a ring may be forged into an annular disk from which rotor blades for a turbomachine may be cut.

The present invention also provides an apparatus for the horizontal centrifugal casting of a semifinished TiAl part (e.g., by the process set forth above, including the various aspects thereof). The apparatus comprises at least one permanent mold which can be rotated about a horizontal axis of rotation and at least one feeder which can project into the permanent mold to introduce a melt into the at least one permanent mold. The feeder is inductively heatable.

In one aspect of the apparatus, the feeder may comprise a channel which is open at its top. Further, the feeder may be cooled by a fluid and/or the feeder may be made of copper materials and/or niobium materials and/or molybdenum materials.

In another aspect of the apparatus, the feeder may be surrounded by at least one coil and/or the permanent mold may be made of steel and/or copper materials and/or niobium materials.

As set forth above, the invention proposes producing TiAl components composed of TiAl materials by forging, using a semifinished TiAl cast part which has been produced by horizontal centrifugal casting as semifinished part for the forging. It has unexpectedly been found that semifinished TiAl cast parts produced by horizontal centrifugal casting can advantageously be used for further processing by forging in order to provide TiAl components having a particularly advantageous property profile in a simple and efficient way for use in turbo machines.

In horizontal centrifugal casting, which is to be used according to the present invention for producing semifinished TiAl cast parts for subsequent forging, a permanent mold into which the melt of the material to be cast is introduced and which provides the appropriate shapes for the semifinished parts is rotated about a horizontal axis. Here, horizontal means that the axis is aligned transverse, in particular perpendicular, to the direction of gravity with deviations by a few degrees being permissible in terms of industrial implementation accuracy, i.e., for example, deviations of up to +/−10°, preferably +/−50. Horizontal centrifugal casting allows high cooling rates to be achieved at high rotational speeds of the permanent mold, so that demixing phenomena in the TiAl alloy can be avoided and a fine microstructure can be produced. In addition, semifinished parts having large wall thicknesses or semifinished parts in the form of cylinders and cones can be produced in a materials-saving manner.

For the purposes of the present invention, a TiAl alloy is a material which comprises titanium and aluminum as main constituents, so that these form the largest alloy constituents. They are in particular materials which have intermetallic phases such as $\alpha_2$-$Ti_3Al$ and γ-TiAl, preferably likewise as constituents which make up the largest proportion by volume of a component made of such a material.

In particular, the TiAl alloy can be a TNM alloy which has niobium and molybdenum as further constituents, since such alloys have particularly good mechanical properties for use in turbo machines. In particular, this alloy may be a TNM alloy having the composition about 43.5% by weight of aluminum, about 4% by weight of niobium, about 1% by weight of molybdenum and about 0.1% by weight of boron with the balance being titanium and unavoidable impurities and/or alloy constituents having proportions of in each case <0.5% by weight up to a total proportion of ≤5% by weight, in particular ≤2% by weight. The proportion of aluminum in such an alloy may range from 40 to 50% by weight, in particular from 42 to 45% by weight, while the proportion of niobium may range from 2 to 6% by weight and in particular from 3 to 5% by weight. The proportion of molybdenum may in turn range from 0.5 to 2% by weight, while boron may be present in a range from 0.05% by weight to 0.15% by weight.

The semifinished TiAl cast part which can be produced by the horizontal centrifugal casting process may have a shape selected from cylinders, cones and rings, since these shapes represent advantageous blanks for the subsequent forging process.

The semifinished TiAl cast part may be cast in the centrifugal casting process in such a way that the appropriate shapes such as cylinders, cones or rings are formed as separate semifinished cast parts. In addition, it is also possible to produce the desired semifinished TiAl cast parts by parting, in particular dividing or machining, from a single cast piece or a plurality of cast pieces. For example, it is possible to produce a cylindrical tube by horizontal centrifugal casting and subsequently divide or part this by mechanical parting processes such as cutting, sawing, milling or the like to give appropriate rings and use these rings as semifinished TiAl cast parts for subsequent forging.

In the horizontal centrifugal casting process, semifinished TiAl cast parts in the form of rings or tubes having a length of from 5 to 300 cm and/or wall thicknesses of from 4 to 30 cm and/or internal diameters of from 10 to 100 cm may be cast as individual cast pieces.

As a result of the rapid cooling which is possible by the centrifugal casting process, it is possible to produce the semifinished cast part with a microstructure having colonies of α-titanium and γ-TiAl in a β-titanium matrix, with γ-TiAl precipitates being able to be additionally present in the β-titanium matrix. The γ-TiAl precipitates in the β-titanium matrix may be lens-shaped and/or the colonies of α-titanium and γ-TiAl may have an elongated shape. Furthermore, the γ-TiAl in the colonies may be provided in the form of fine lamellae.

The phase composition of the semifinished TiAl cast part may be close to the equilibrium phase composition at room temperature and deviate by only up to 10% by volume and in particular up to 8% by volume from the equilibrium composition at room temperature. This means that the semifinished cast part has other phases only in amounts in the order of up to 10% by volume or up to 8% by volume compared to the equilibrium composition at room temperature.

After production of the semifinished TiAl cast part, this can be converted in one or more forming steps by forging and/or with at least one heat treatment into a TiAl component or semifinished TiAl part which can be made into the desired TiAl component merely by minor further working, which further working may comprise, in particular, appropriate surface working or removal of flash or edges.

In particular, a semifinished TiAl cast part in the form of a ring may be forged to give an annular disk from which appropriate blades for turbomachines can be cut.

To ensure that the TiAl melt can be introduced with a sufficiently high temperature, i.e. in a superheated state, into the permanent mold, it is also proposed that an inductively heatable feeder by means of which the melt is introduced into the permanent mold be provided in the apparatus for horizontal centrifugal casting. To effect inductive heating, the feeder can be surrounded by at least one coil.

The feeder can be configured as a channel which is open at the top and can be coolable by means of a fluid such as water and can preferably be made of copper materials, niobium materials or molybdenum materials. For the purposes of the present invention, copper materials, niobium materials or molybdenum materials are materials which have copper, niobium or molybdenum as main constituent.

The permanent mold can be made of a steel material and/or copper material and/or niobium material in order to allow heat to be conducted away rapidly. Once again, copper materials and niobium materials are materials which have copper or niobium as main constituent.

To improve the conduction of heat away from the permanent mold, the permanent mold can also have cooling channels for fluids such as water and the like.

BRIEF DESCRIPTION OF THE DRAWINGS

The accompanying drawings show, in a purely schematic way.

DETAILED DESCRIPTION OF EMBODIMENTS OF THE INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show details of the present invention in more detail than is necessary for the fundamental understanding of the present invention, the description in combination with the drawings making apparent to those of skill in the art how the several forms of the present invention may be embodied in practice.

Figure 1:
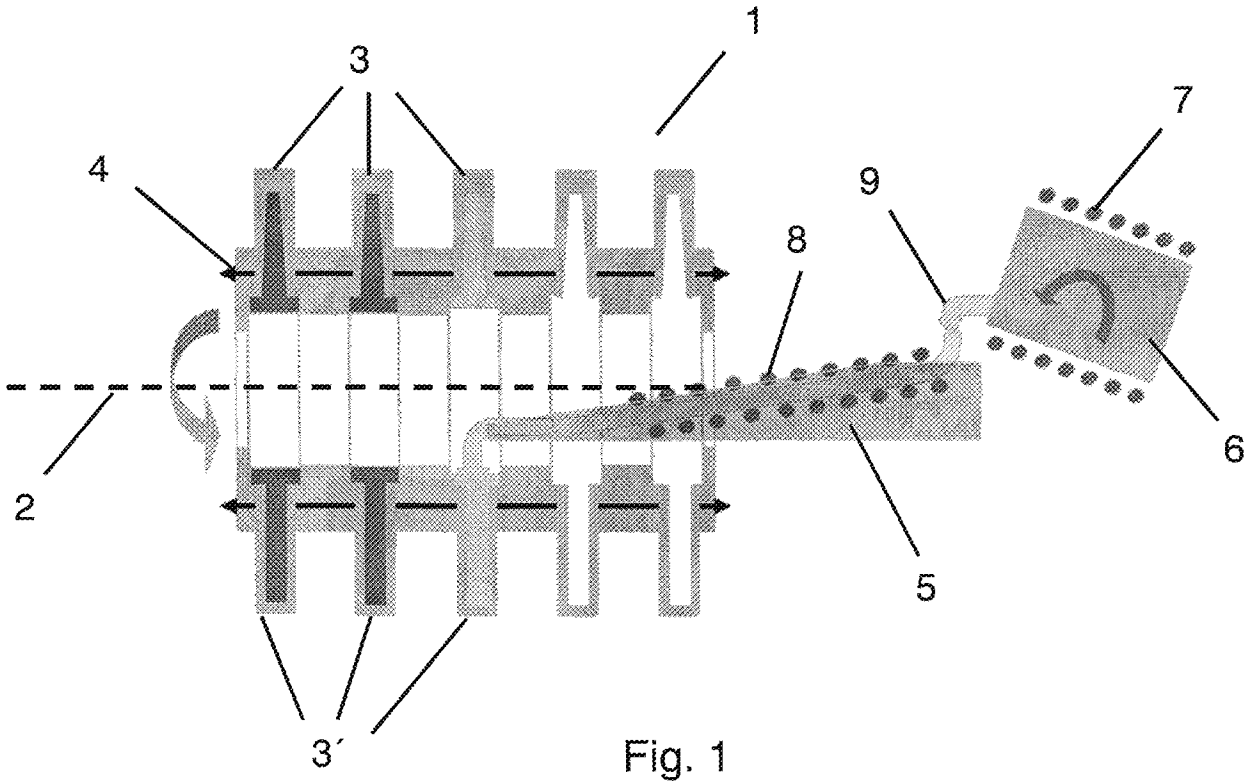
FIG. 1 a depiction of the horizontal centrifugal casting process for producing cone-shaped or cylindrical semifinished TiAl cast parts, FIG. 2 a sectional view of a permanent mold after centrifugal casting, FIG. 3 a perspective view of the permanent mold of FIGS. 1 and 2, FIG. 4 a further depiction of a centrifugal casting apparatus for carrying out a centrifugal casting process as per a second embodiment of the invention, FIG. 5 a sectional view of the permanent mold of FIG. 4 after completion of centrifugal casting, FIG. 6 a perspective view of the permanent mold of FIGS. 4 and 5, FIG. 7 a depiction of the course of the centrifugal casting process in subfigures a) to e) in the embodiment depicted in FIGS. 4 to 6, FIG. 8 a schematic depiction of the microstructure of a semifinished TiAl cast part after centrifugal casting and FIG. 9 a depiction of a forging step for converting a ring into a disk.

FIG. 1 shows, in a schematic sectional view, an apparatus and a process for the centrifugal casting of semifinished TiAl cast parts according to the present invention, which parts can subsequently be converted by forming by forging into TiAl components which can, in particular, be used in turbomachines such as aircraft engines.

The apparatus comprises a permanent mold 1 which has a plurality of molds 3, 3' into which the material to be cast is introduced. In the permanent mold 1 of the embodiment depicted in FIG. 1, the molds 3, 3' are molds for producing cones and cylinders, which are arranged at a distance from one another along the longitudinal axis 2 of the permanent mold 1 and along the circumferential wall of the permanent mold 1.

During centrifugal molding by means of which the molds 3, 3' of the permanent mold 1 are filled with the appropriate melt, the permanent mold 1 is rotated about the permanent mold longitudinal axis 2 so that the material to be cast, e.g. in the form of a TiAl alloy, which is introduced in molten form into the permanent mold 1 is pushed by centrifugal force into the molds 3, 3'.

The molten TiAl alloy 9 is provided from a melting crucible 6 which can be heated by a heating device 7, with the molten TiAl alloy being introduced via a feeder 5 into the permanent mold 1.

As can be seen from FIG. 1, the feeder 5 is moved along the longitudinal axis 2 of the permanent mold 1, so that the molds 3, 3' arranged at a distance from one another along the longitudinal axis 2 can be filled successively.

To ensure very rapid solidification of the TiAl alloy in the permanent mold 1 or in the molds 3, 3', cooling channels 4 through which cooling liquid, for example water, can flow are provided in the permanent mold 1.

To ensure that the molten TiAl alloy 9 can be introduced in a molten, superheated state into the permanent mold 1 and the molds 3, 3', the feeder 5 is provided with induction heating 8, with a coil arranged around a channel of the feeder 5, said channel being open in the upward direction, being provided for induction heating 8. The coil 8 enables the molten TiAl alloy 9 to be inductively maintained at temperature during its passage through the feeder 5 to the molds 3, 3'.

Figures 2, 3:
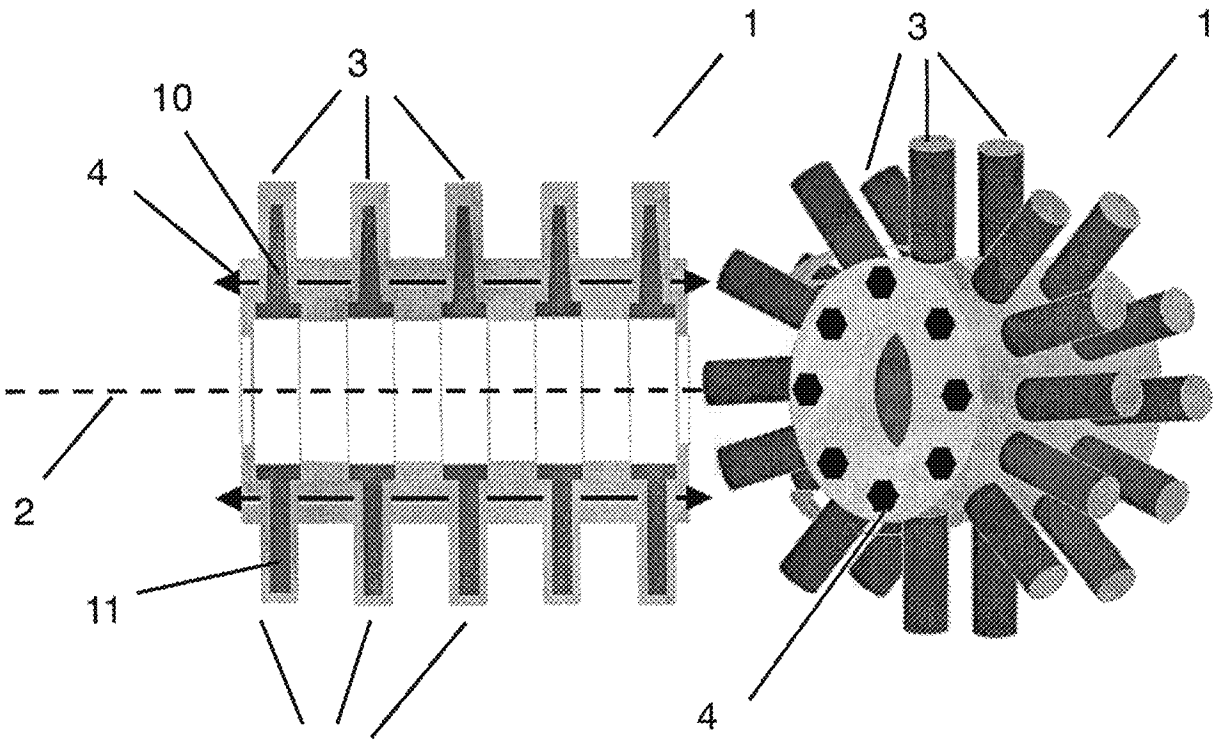

FIG. 2 shows the permanent mold 1 after horizontal centrifugal casting, with all molds 3, 3' being filled with the cast TiAl material and the semifinished TiAl cast parts being able to be taken out in the form of cones 10 and cylinders 11 and the permanent mold 1, which is shown later in another working example, being able to be disassembled into corresponding individual parts in order to be able to take out the semifinished TiAl cast parts.

FIG. 3 shows the permanent mold 1 in a perspective view in which the individual molds 3, 3' and their spaced arrangement in the circumferential direction and longitudinal direction of the cylindrical permanent mold 1 can clearly be seen. In addition, it can be seen in FIG. 3 that a plurality of cooling channels 4 are arranged next to one another in the circumferential wall of the permanent mold 1 and run in the longitudinal direction of the permanent mold 1.

FIGS. 4 to 7 show a further working example of the process according to the invention and the apparatus for producing centrifugally cast semifinished TiAl cast parts as precursors for the production of forged TiAl components. The second embodiment differs from the previous embodiment only in that differently shaped semifinished TiAl cast parts 12 are formed and the permanent mold 1 correspondingly has different molds 3". Instead of the cones and cylinders as are produced in the working example of FIGS. 1 to 3, a plurality of rings or tubes 12 (see FIG. 5) are formed in the working example of FIG. 4, with the corresponding molds 3" being formed by circumferential depressions in the permanent mold wall 1. Otherwise, the process and the apparatus of FIG. 4 do not differ further from the embodiment of FIG. 1, so that the identical components are provided with identical reference numerals and a repeated description of these identical components will be dispensed with.

Figure 7:
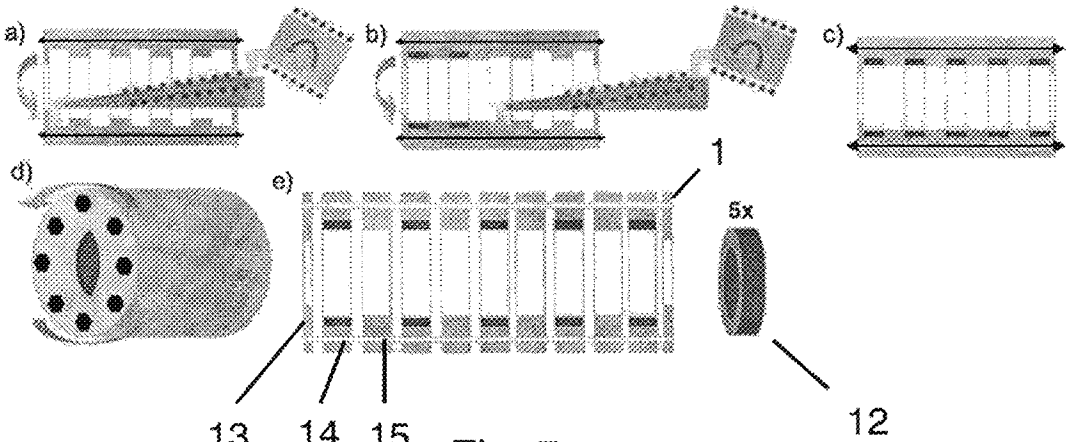

FIG. 7 shows, in a juxtaposition in subfigures a) to e), the course of the process of the invention in respect of centrifugal casting to produce semifinished TiAl cast parts as precursors for the forging of TiAl components from the semifinished TiAl cast parts.

The subfigures a) to d) correspond to the depictions in FIGS. 4 to 6, with the commencement of centrifugal casting in which the feeder 5 fills the first row of the molds 3" with the material to be cast being shown in subfigure a), while in subfigure b), the feeder 5 has already been moved along the longitudinal axis 2 of the permanent mold 1 and fills the third row of molds 3" with molten TiAl alloy.

Subfigure e) of FIG. 7 shows how the permanent mold 1 is made up of a plurality of parts, namely various ring segments 13 to 15 which are taken apart in order to take out the solidified semifinished TiAl cast parts in the form of rings 12. In the working example shown in FIG. 7*e*), each permanent mold 1 consists of an end plate 13 and a plurality of ring-shaped mold segments 14 and separator segments 15 which are arranged alternately next to one another so as to form the molds 3". In the working example shown in FIG. 7*e*), five molds for forming rings 12 are provided, although the permanent mold 1 can also be made longer with a larger number of ring segments 14, 15 in order to form a greater number of rings 12.

Figure 8:
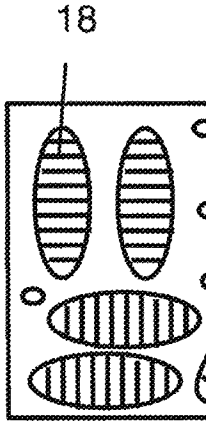

FIG. 8 schematically shows a polished section to depict the microstructure of a semifinished TiAl cast part after centrifugal casting. It can be seen in FIG. 8 that the microstructure is formed by a plurality of colonies 16 of α-titanium and γ-TiAl, with the γ-TiAl being present in the form of lamellae 18 in the colonies 16. The colonies 16 have an elongated shape and are embedded in a β-titanium matrix 17 which additionally has lens-shaped γ-TiAl precipitates 19. The microstructure does not have any globular γ-TiAl grains and gives the material a tensile strength of from 650 to 800 MPa at a total elongation of from 0.2 to 0.9%. The microstructure is very close to the equilibrium phase composition at room temperature, with the deviation from the equilibrium phase composition at room temperature being only up to 10% by volume, preferably up to 8% by volume, of the microstructure.

Figure 9:
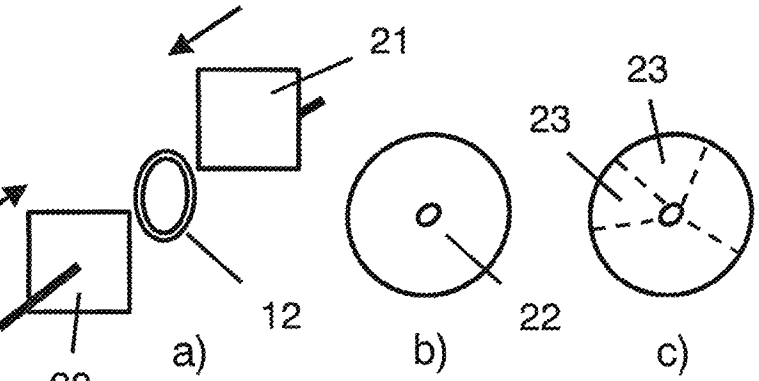

The semifinished TiAl cast parts produced by horizontal centrifugal casting are highly suitable for further processing to give forged TiAl components, as is shown in FIG. 9. In FIG. 9, the semifinished TiAl cast parts in the form of rings 12, as have been produced, for example, by the process shown in FIG. 7, are converted in a forge by means of appropriate forging tools 20, 21 into a forged TiAl component in the form of an annular disk 22 (see subfigure b) of FIG. 9) from which corresponding TiAl components 23 such as rotor blades or the like can be cut as per the depiction in FIG. 9*c*), as is indicated by the broken lines in FIG. 9*c*).

Although the present invention has been described in detail for the working examples, it will be obvious to a person skilled in the art that the invention is not restricted to these working examples, but that modifications arrived at by leaving out individual features or by means of other combinations of features can be realized, as long as these do not go outside the scope of protection of the accompanying claims. The present disclosure encompasses all combinations of the present individual features.

LIST OF REFERENCE NUMERALS

1 Permanent mold
2 Longitudinal axis of permanent mold
3, 3', 3" Mold
4 Cooling channel
5 Feeder
6 Melting crucible
7 Heating device
8 Induction coil
9 Melt
10 Cone
11 Cylinder
12 Ring
13 End plate
14 Mold segment
15 Separator segment
16 Colony
17 Matrix
18 Lamellae
19 Lens-shaped precipitate
20 Forging tool
21 Forging tool
22 Disk
23 Component

What is claimed is:

1. A process for producing a forged component of a TiAl alloy, wherein the process comprises casting a melt of the TiAl alloy by horizontal centrifugal casting to produce at least one semifinished TiAl cast part and forging the at least one semifinished TiAl cast part into a forged TiAl part.

2. The process of claim 1, wherein the at least one semifinished TiAl cast part is in the form of a cylinder, a cone or a ring.

3. The process of claim 1, wherein the at least one semifinished TiAl cast part is produced by parting.

4. The process of claim 3, wherein the at least one semifinished TiAl cast part is produced by dividing or machining of a cast piece.

5. The process of claim 1, wherein the TiAl alloy is cast in a permanent mold to afford a plurality of separated semifinished TiAl cast parts.

6. The process of claim 1, wherein the TiAl alloy is cast to afford a semifinished TiAl cast part in the form of a ring or tube having a length of from 5 to 300 cm and/or a wall thickness of from 4 to 30 cm and/or an internal diameter of from 10 to 100 cm.

7. The process of claim 1, wherein the TiAl alloy is a TNM alloy comprising niobium and molybdenum constituents.

8. The process of claim 7, wherein the TiAl alloy comprises, based on a total weight of the alloy, from 40 to 50% by weight aluminum, from 2 to 6% by weight niobium, from 0.5 to 2% by weight molybdenum, from 0.05% by weight to 0.15% by weight boron, balance Ti and unavoidable impurities and/or alloy constituents in proportions of in each case less than 0.5% by weight up to a total proportion of not more than 5% by weight.

9. The process of claim 8, wherein the TiAl alloy comprises, in percent by weight based on a total weight of the alloy, Al—43.5, Nb—4, Mo—1, B—0.1.

10. The process of claim 1, wherein the semifinished TiAl cast part has a microstructure formed by colonies of $\alpha$-Ti and $\gamma$-TiAl which are embedded in $\beta$-Ti.

11. The process of claim 1, wherein a phase composition of the at least one semifinished TiAl cast part deviates from an equilibrium phase composition at room temperature by up to 10% by volume.

12. The process of claim 1, wherein a phase composition of the at least one semifinished TiAl cast part deviates from an equilibrium phase composition at room temperature by up to 8% by volume.

13. The process of claim 1, wherein the at least one semifinished TiAl cast part is subjected to a plurality of forming steps by forging and/or at least one heat treatment.

14. The process of claim 1, wherein the at least one semifinished TiAl cast part in the form of a ring is forged into an annular disk from which rotor blades for a turbomachine may be cut.

* * * * *